US010864738B2

(12) United States Patent
Gasso Puchal et al.

(10) Patent No.: US 10,864,738 B2
(45) Date of Patent: Dec. 15, 2020

(54) IMMISCIBLE FLUID APPLICATOR

(71) Applicant: HEWLETT-PACKARD DEVELOPMENT COMPANY, L.P., Houston, TX (US)

(72) Inventors: Xavier Gasso Puchal, Barcelona (ES); Gonzalo Gaston Llado, Barcelona (ES); Marian Dinares Argemi, Terrassa (ES); Jeffrey Allen Wagner, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 268 days.

(21) Appl. No.: 15/329,052

(22) PCT Filed: Jul. 30, 2014

(86) PCT No.: PCT/US2014/048803
§ 371 (c)(1),
(2) Date: Jan. 25, 2017

(87) PCT Pub. No.: WO2016/018282
PCT Pub. Date: Feb. 4, 2016

(65) Prior Publication Data

US 2017/0210136 A1 Jul. 27, 2017

(51) Int. Cl.
*B41J 2/165* (2006.01)
*B41J 2/175* (2006.01)

(52) U.S. Cl.
CPC ..... *B41J 2/16552* (2013.01); *B41J 2/16505* (2013.01); *B41J 2/16538* (2013.01); *B41J 2/1753* (2013.01); *B41J 2/17546* (2013.01); *B41J 2002/16558* (2013.01)

(58) Field of Classification Search
CPC ..... B41J 2/16552; B41J 2/16535; B41J 2/16541; B41J 2/16538; B41J 2/1606; B41J 2/16585; B41J 2202/21
See application file for complete search history.

(56) References Cited

U.S. PATENT DOCUMENTS 4,148,041 A * 4/1979 Rosenstock ..... B41J 2/19 347/28
4,734,706 A * 3/1988 Le ..... B41J 2/20 239/104
6,102,518 A 8/2000 Taylor
(Continued)

*Primary Examiner* — John Zimmermann
(74) *Attorney, Agent, or Firm* — HP Inc. Patent Department

(57) ABSTRACT

A printer may comprise a printhead comprising a number of nozzles, an immiscible fluid applicator, and a processor to instruct the immiscible fluid applicator to apply immiscible fluid onto the surface of the printhead to cap the number of nozzles. A printer subassembly may comprise an immiscible fluid applicator to wipe a layer of immiscible fluid onto a surface of a printhead. A printer may comprise a page wide array printhead, an immiscible fluid applicator to wipe a layer of immiscible fluid over a printhead to cap nozzles over the width of the printhead, and a controller to instruct the printhead to print after the layer of immiscible fluid has been applied over the printhead so that ink ejects through the immiscible fluid while non-used nozzles remain capped by the immiscible fluid layer.

16 Claims, 8 Drawing Sheets

(56) References Cited

U.S. PATENT DOCUMENTS

| | | | | |
|---|---|---|---|---|
| 6,520,621 | B1 * | 2/2003 | Eckard | B41J 2/16547 347/33 |
| 6,578,947 | B1 | 6/2003 | Suwabe et al. | |
| 8,205,959 | B2 | 6/2012 | Morgan et al. | |
| 8,465,121 | B2 | 6/2013 | Yamada et al. | |
| 8,596,769 | B2 * | 12/2013 | Hibbard | B41J 2/1752 347/42 |
| 8,684,494 | B2 | 4/2014 | Ficarra et al. | |
| 8,721,038 | B2 | 5/2014 | McVeigh | |
| 8,820,885 | B2 * | 9/2014 | Hildebrand | B41J 2/16544 347/28 |
| 2002/0171705 | A1 | 11/2002 | Rhoads et al. | |
| 2006/0152558 | A1 | 7/2006 | Hoisington | |
| 2006/0250461 | A1 * | 11/2006 | Silverbrook | B41J 2/16508 347/86 |
| 2008/0273069 | A1 | 11/2008 | Langford et al. | |
| 2009/0225134 | A1 | 9/2009 | Tsukada | |
| 2011/0310181 | A1 | 12/2011 | Curcio et al. | |

* cited by examiner

IMMISCIBLE FLUID APPLICATOR

BACKGROUND

Printing devices comprise a printhead that includes a number of chambers. Each of these chambers includes an ejection device that ejects an amount of fluid such as ink out of the chamber. The chamber is in fluid communication with a nozzle bore that ends in a nozzle. The fluid is ejected out of the nozzle and onto a substrate to form an image.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
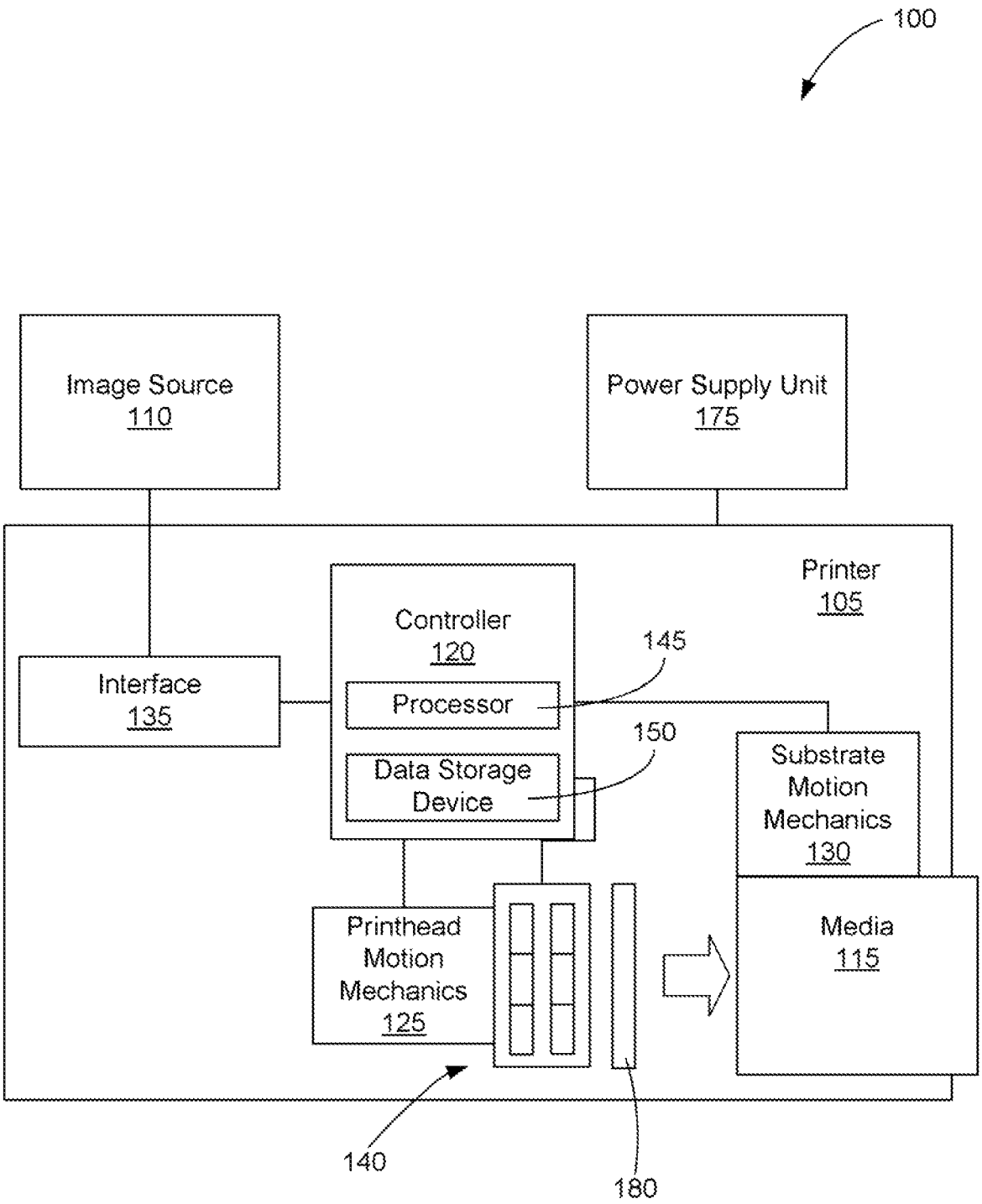
FIG. 1 is block diagram of a printing system according to one example of the principles described herein.

As described above, printing devices comprise number of nozzles from which a fluid is ejected. In one example, a resistor may be placed in each chamber such that when it is heated, a bubble is formed that pushes out an amount of fluid based on the size of the cavity. In another example, a piezoelectric device may be used to eject the fluid out of the chamber by applying an electrical current to a piezoelectric material. In either case, the fluid is ejected through a nozzle bore and nozzle orifice generally defining the nozzle. After ejection, an amount of fluid may be left in the area of the nozzle. Additionally, an amount of fluid may be maintained in the nozzle bore in anticipation for future ejection onto the substrate. A situation in which the nozzle is unused for more than about 5 minutes may be termed "long term decap." Consequently, in the present specification and in the appended claims the term "long term decap" is meant to be understood broadly as any period of time exceeding approximately 5 minutes. In an other example, long term decap may exist at any time starting from 8 seconds and longer.

Noticeable defects caused by long term decap can be seen in the behavior of the printing device over time. In one example, some evaporation of the fluids within, for example, an ink via interaction with atmosphere may occur. The evaporation of some of the components of the fluid may cause changes to the characteristics of the fluid.

The above described evaporation may be delayed somewhat through the use of physical caps that are placed over the nozzles or each individual die of the printhead. These physical caps may use an additional mechanical device to remove them from the nozzles before printing and reapply them after printing. The use of the mechanical device may limit the time that the printer may be used because the removal and application of the caps takes the printhead away from printing on a substrate.

In the present specification and in the appended claims, the term "short term decap" is meant to be understood broadly as any situation in which a nozzle of an printing device is exposed to atmosphere while the printing device is printing onto a substrate. In one example, the exposure to atmosphere during a short term decap also comprises a situation in which the nozzles are not serviced. In one example, the duration of a short term cap may be less than 8 seconds. The definition of a short term cap being 8 seconds is a rough estimate that may be based on a combination of latex within the fluid ejected as well as the size of the page wide array (PWA). "Fly-by spits" and "spit-on-page" are two tools used in inkjet printers to "refresh" nozzles in the middle of a job in order to prevent the effects of short term decap. However, the use of these methods may result in increases in fluid waste and add further wear and tear to the inkjet components as well as other disadvantages.

The present specification, therefore, describes a printhead comprising a number of nozzles, an immiscible fluid applicator, and a processor to instruct the immiscible fluid applicator to apply immiscible fluid onto the surface of the printhead to cap the number of nozzles. In one example, the immiscible fluid is an isoparaffin.

The present specification further describes printer subassembly comprising an immiscible fluid applicator to wipe a layer of immiscible fluid onto a surface of a printhead. In one example, the immiscible fluid is an isoparaffin.

The present specification further describes a printer may comprise a page wide array printhead, an immiscible fluid applicator to wipe a layer of immiscible fluid over a printhead to cap nozzles over the width of the printhead, and a controller to instruct the printhead to print after the layer of immiscible fluid has been applied over the printhead so that ink ejects through the immiscible fluid while non-used nozzles remain capped by the immiscible fluid layer. In one example, the immiscible fluid is an isoparaffin.

As used in the present specification and in the appended claims, the term "fluid" is meant to be understood broadly as any substance that continually deforms under an applied shear stress. In one example, a fluid may be a pharmaceutical. In another example, the fluid may be an ink. In another example, the fluid may be a liquid.

Additionally, as used in the present specification and in the appended claims, the term "substrate" is meant to be understood broadly as any surface onto which a fluid ejected from a nozzle of a printer may be deposited. In one example, the substrate may be paper. In another example, the substrate may be an edible substrate. In yet one more example, the substrate may be a medicinal pill. In yet another example, a substrate may include a material into which a fluid is deposited such as in a three-dimensional printing process.

Also, as used in the present specification and in the appended claims, the term "printer" is meant to be understood broadly as any device capable of selectively placing a fluid onto a substrate. In one example the printer is an inkjet printer. In another example, the printer is a three-dimensional printer. In yet another example, the printer is a digital titration device.

Further, as used in the present specification and in the appended claims, the term "immiscible fluid" is meant to be understood broadly as any fluid that does not mix with another fluid. In one example, the immiscible fluid does not mix with ink. In another example, the immiscible fluid does not chemically react with a fluid present in a printer cartridge.

Even further, as used in the present specification and in the appended claims, the term "printhead" is meant to be understood broadly as any portion of a printer that interfaces with a substrate to deposit an amount of fluid onto the substrate via a number of nozzles.

Even still further, as used in the present specification and in the appended claims, the term "page-wide area printhead" is meant to be understood broadly as any printhead that has a width that is equal to or larger than a sheet of substrate.

Additionally, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with that example is included as described, but may not be included in other examples.

Turning now to the figures, FIG. 1 is block diagram of a printing system (100) according to one example of the principles described herein. The printing system (100) may comprise a printer (105), an image source (110), and a media (115). The printer (105) may comprise a controller (120), printhead motion mechanics (125), substrate motion mechanics (130), an interface (135), and a printhead (140). The controller (120) may comprise a processor (145) and a data storage device (150). Each of these will now be described in more detail.

The printer (105) may comprise an interface (135) to interface with an image source (110). The interface (135) may be a wired or wireless connection connecting the printer (105) to the image source (110). The image source may be any source from which the printer (105) may receive data describing a print job to be executed by the controller (120) of the printer (105) in order to, for example, print an image onto the media (115). In one example, the image source may be a computing device communicatively coupled with the printer (105).

The interface (135) may also enable the printer (105) and specifically the processor (145) to interface with various hardware elements, such as the image source (110), external and internal to the printer (105). For example, the interface (135) may interface with an input or output device such as, for example, display device, a mouse, or a keyboard. The interface (135) may also provide access to other external devices such as an external storage device, a number of network devices such as servers, switches, and routers, client devices, other types of computing devices, and combinations thereof.

The processor (145) may include the hardware architecture to retrieve executable code from the data storage device (150) and execute the executable code. The executable code may, when executed by the processor (145), cause the processor (145) to implement at least the functionality of printing on the media (115), and actuating the printhead and substrate motion mechanics (125, 130), according to the methods of the present specification described herein. The executable code may, when executed by the processor (145), cause the processor (145) to implement the functionality of providing instructions to the power supply unit (175) such that the power supply unit (175) provides power to the printhead (140) to eject a fluid from a number of nozzles defined in the dies. In one example, the number of nozzles fired may be a number less than the total number of nozzles available and defined on the printhead (140).

The data storage device (150) may store data such as executable program code that is executed by the processor (145) or other processing device. The data storage device (150) may specifically store computer code representing a number of applications that the processor (145) executes to implement at least the functionality described herein.

The data storage device (150) may include various types of memory modules, including volatile and nonvolatile memory. For example, the data storage device (150) of the present example includes Random Access Memory (RAM), Read Only Memory (ROM), and Hard Disk Drive (HDD) memory. Many other types of memory may also be utilized, and the present specification contemplates the use of many varying type(s) of memory in the data storage device (150) as may suit a particular application of the principles described herein. In certain examples, different types of memory in the data storage device (150) may be used for different data storage needs. For example, in certain examples the processor (145) may boot from Read Only Memory (ROM) (150), maintain nonvolatile storage in the Hard Disk Drive (HDD) memory, and execute program code stored in Random Access Memory (RAM).

Generally, the data storage device (150) may comprise a computer readable medium, a computer readable storage medium, or a non-transitory computer readable medium, among others. For example, the data storage device (150) may be, but not limited to, an electronic, magnetic, optical, electromagnetic, infrared, or semiconductor system, apparatus, or device, or any suitable combination of the foregoing, More specific examples of the computer readable storage medium may include, for example, the following: an electrical connection having a number of wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a computer readable storage medium may be any tangible medium that can contain, or store computer usable program code for use by or in connection with an instruction execution system, apparatus, or device. In another example, a computer readable storage medium may be any non-transitory medium that can contain, or store a program for use by or in connection with an instruction execution system, apparatus, or device.

The printhead and substrate motion mechanics (125, 130) comprise mechanical devices that may move the printhead (140) and media (115) respectively. Instructions to move the printhead (140) and media (115) may be received and processed by the controller (120) and signals may be sent to the printhead (140) and substrate motion mechanics (130) from the controller (120).

The printhead (140) may cause an amount of fluid to be ejected onto a substrate (115) in order to form some image on the substrate (115). In one example, the printhead (140) may deliver a material or inject active components into a volume. The printhead (140) may be any type of fluid depositing such as an inkjet printhead, a thermal inkjet printhead, a piezoelectric inkjet printhead, among others. Consequently, the present description contemplates the use of the immiscible fluid and immiscible fluid applicator (180) described below in connection with any printing device that uses any type of printhead.

As discussed above, the printhead (140) may comprise a number of nozzles. In some examples, the printhead (140) may be broken up into a number of print dies with each die comprising a number of nozzles. The printhead (140) may be any type of printhead including, for example, a cartridge or a wide array. These examples are not meant to limit the present description. Instead, various types of printheads may be used in conjunction with the present principles described herein.

The printer (105) may further comprise an immiscible fluid applicator (180). The immiscible fluid applicator (180) is an applicator that applies an amount of immiscible fluid to at least a portion of the printhead (140). In one example, the immiscible fluid applicator (180) may be placed inline with the printhead (140) and media (115). In this example, the immiscible fluid applicator (180) may be placed directly by the printhead (140) such that the immiscible fluid applicator (180) may move relative to the printhead (140) and supply the printhead (140) with the amount of immiscible fluid. In another example, the immiscible fluid applicator (180) may be stationary and the printhead (140) moves relative to it in order to have access to the caps. In yet another example, the printhead (140) and the immiscible fluid applicator (180) may both move relative to each other allowing each to come closer to the other in order to supply the amount of immiscible fluid to the surface of the printhead (140).

In still another example, the immiscible fluid applicator (180) may be offline such that the printer (105) does not engage in any printing processes until an application procedure using the immiscible fluid applicator (180) is complete. In this example the printhead (140) may move relative to the immiscible fluid applicator (180), the immiscible fluid applicator (180) may move relative to the printhead (140), or both the immiscible fluid applicator (180) and printhead (140) may move so as to come together so that the immiscible fluid applicator (180) may apply a layer of immiscible fluid to the printhead (140).

Figure 2:
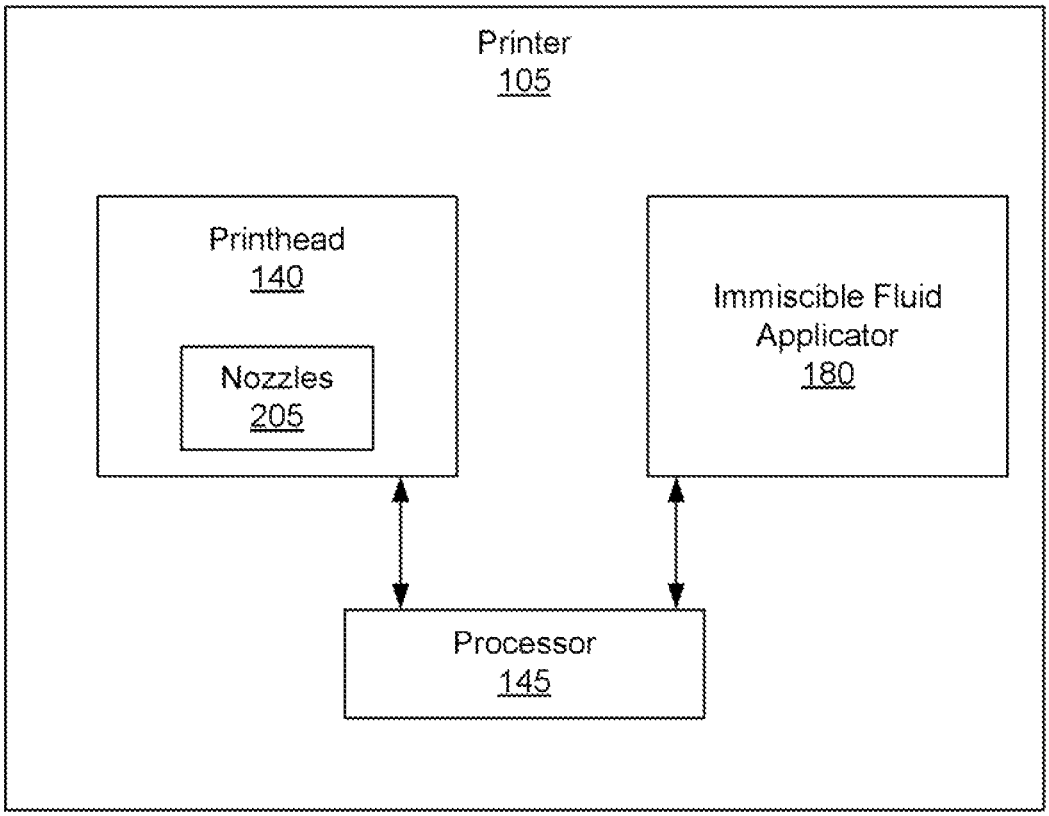
FIG. 2 is a block diagram of a printer according to one example of the principles described herein.

Further details of the printer in the printing system are now discussed in reference to FIG. 2. FIG. 2 is a block diagram of a printer according to one example of the principles described herein. The printer (105) comprises a printhead (140) and an immiscible fluid distribution system (180). The printhead (140) may comprise a number of nozzles (205). In one example, the number of nozzles (205) are grouped together forming a single die of nozzles. The printer (105) may further comprise a processor (145) in electrical communication with the printhead (140), nozzles (205), and immiscible fluid applicator (180). The immiscible fluid applicator (180) may comprise any type of system that applies an immiscible fluid to the nozzle plate of a printhead (140) thereby capping, at least partially, a nozzle located thereon.

Figure 3A:
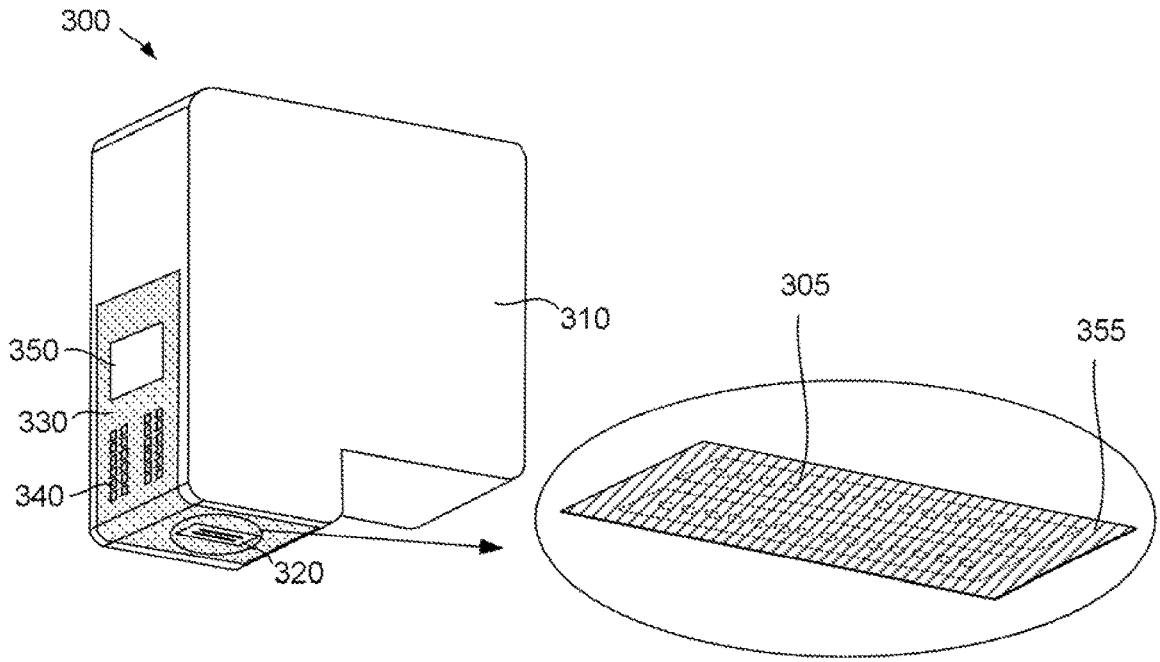
FIG. 3A is a diagram of a printing cartridge comprising a number of nozzles according to one example of the principles described herein.

As will be describe in more detail below, the printhead (140) operates with a number of dies being capped by the immiscible fluid. The application of the immiscible fluid may be accomplished in a number of ways. The FIG. 3A is a diagram of a printing cartridge (300) comprising a number of nozzles according to one example of the principles described herein. The cartridge (300) comprises a fluid reservoir (310), a die (320), a flexible cable (330), conductive pads (340), and a memory chip (350). The flexible cable (330) is adhered to two sides of the cartridge (300) and contains traces that electrically connect the memory (350) and die (320) with the conductive pads (340).

The cartridge (300) may be installed into a cradle that is integral to the carriage of a printer (FIG. 1, 105). When the cartridge is correctly installed, the conductive pads (340) are pressed against corresponding electrical contacts in the cradle, allowing the printer (FIG. 1, 105) to communicate with, and control the electrical functions of, the cartridge (300). For example, the conductive pads (340) allow the printer (FIG. 1, 105) to access and write to the fluid-jet memory chip (350).

The memory chip (340) may contain a variety of information including the type of fluid cartridge, the kind of fluid contained in the cartridge, an estimate of the amount of fluid remaining in the fluid reservoir (310), calibration data, error information, and other data. In one example, the memory chip (340) may comprise information regarding when the cartridge (300) should be maintained. As described herein, the maintenance may comprise applying a layer of immiscible fluid (355) to the surface of the die (320). The printer (FIG. 1, 105) can take appropriate action based on the information contained in the cartridge memory (340), such as notifying the user that the fluid supply is low or altering printing routines to maintain image quality. The cartridge memory (340) is shown as a separate element that is distinct from the die (320). However, according to one example, the die (320) may contain the memory in addition to the elements used to dispensing the fluid.

To create an image, the printer moves the carriage containing the cartridge over a piece of print media (FIG. 1, 115). At appropriate times, the printer sends electrical signals to the fluid-jet cartridge (300) via the electrical contacts in the cradle. The electrical signals pass through the conductive pads (340) and are routed through the flexible cable (330) to the die (320). The die (320) then ejects a small droplet of fluid from the reservoir (310) onto the surface of the substrate. These droplets combine to form an image on the surface of the substrate (FIG. 1, 115).

The die (320) may comprise any number of nozzles (305). In an example where the fluid is an ink, a first subset of nozzles (305) may eject a first color of ink while a second subset of nozzles (305) may eject a second color of ink. Additional groups of nozzles (305) may be reserved for additional colors of ink. During operation, the immiscible fluid applicator (FIG. 1, 180) may distribute a layer of immiscible fluid (355) onto the die (320). The immiscible fluid (355) may cover each nozzle (305) of the die (320) such that ambient air does not come in contact with the fluid located within the nozzles (305) or nozzle bore. The immiscible fluid (355) may remain on the die (320) after any of the nozzles (305) have been fired.

The immiscible fluid may be formed such that the above advantages may be realized. In one example, the immiscible fluid has a viscosity of 0.8 to 5 centipoise (cp) (0.01-0.05 kg*m−1*s−1). In another example, the immiscible fluid has a viscosity of 1 to 2 centipoise. In yet another example, the immiscible fluid has a viscosity of 1.5457 cp.

In one example, the surface tension is 18-35 mN/m. In another example, the immiscible fluid has a surface tension of 22-27 mN/m. In yet another example, the surface tension is 25.1 mN/m. The surface tension of the immiscible fluid sufficiently wets the surface of the die (320) while still allowing the layer of immiscible fluid (355) to reform over the nozzle (305) after firing. The immiscible fluid may spread sufficiently over the die (320) but not be too far so as to allow exposure in the printing fluid to ambient air and evaporation. The viscosity may also be low enough so as to not plug any of the nozzle bores thereby preventing firing of fluid through the immiscible fluid layer.

In one example, the molecular weight of the immiscible fluid is 130 to 300 g/mol. In another example, the immiscible fluid has a molecular weight of 165 to 177 g/mol. In yet one example, the molecular weight of the immiscible fluid is 171 g/mol.

In one example, the immiscible fluid is soluble to 200 part per million (ppm) in 20° Celsius water at 1 atm. In one example, the density of the immiscible fluid is at 10° C. is 0.6 to 1.2 g/cm3. In another example, the density of the immiscible fluid at 10° C. is 0.7 to 0.8 g/cm$^3$. In yet another example, the density of the immiscible fluid at 15° C. is 0.779 g/cm$^3$. In one example, the boiling point of the immiscible fluid is within environmental range while also being able to jet under, for example, thermal-ink jet condition. In this example, the boiling point may be between 185 and 260° C. In another example, the boiling point of the immiscible fluid is between 188° C. to 192° C. In yet another example, the boiling point is 190° C.

In one example, the immiscible fluid is a paraffin liquid or an isoparaffin liquid such as Isopar™. In another example, the immiscible fluid may be Isopar™ J, Isopar™ K, Isopar™ L, Isopar™ M, Isopar™ P, polypropylene glycol (PPG), or combinations thereof. In one example, the immiscible fluid is Isopar™ L.

Additionally, the immiscible fluid does not react with the fluid present in the firing chambers connected to the nozzle bores and nozzles. Consequently, in the present specification and in the appended claims, the term "immiscible fluid" is meant to be understood broadly as any fluid that is incapable of mixing with another fluid. As such, in one example, the immiscible fluid forms a coating over the fluid present in the nozzle bore sealing the fluid in the immediate portions of the nozzle and nozzle bore interface. The immiscible fluid is also substantially non-evaporative or substantially nonvolatile such that it does not evaporate when subject to ambient air or temperatures. In one example, the immiscible fluid is less volatile as compared to the jettable fluid within the nozzles. In one example, the evaporation rate of the immiscible fluid is 6 with n-BuAc equal to 100.

In another example, the characteristics of the immiscible fluid may allow the immiscible fluid to flow further into the nozzle bore and into the firing chamber. However, in one example, due to the surface tension properties of the immiscible fluid, the immiscible fluid will still form a seal over the fluid present in the firing chamber by adhering to the surface of the nozzle bore while not adhering to other types of surfaces such as a piezoelectric material in a piezoelectric ink-jet firing chamber or a resistor in a thermal ink-jet firing chamber.

Still further, in one example, the immiscible fluid may be hydrophobic. In this example, when the layer of immiscible fluid is deposited over the printhead (320) and a fluid chamber associated with a nozzle bore and nozzle engages in a firing procedure, the jettable fluid separates the layer of immiscible fluid as it exists from the nozzle. After the fluid has been ejected from the nozzle, the immiscible fluid rebounds to once again seal and cover the nozzle due to the surface tension property of the immiscible fluid. This process may continue on throughout the printing process or until a new layer of immiscible fluid is deposited over the printhead (320).

Figure 3B:
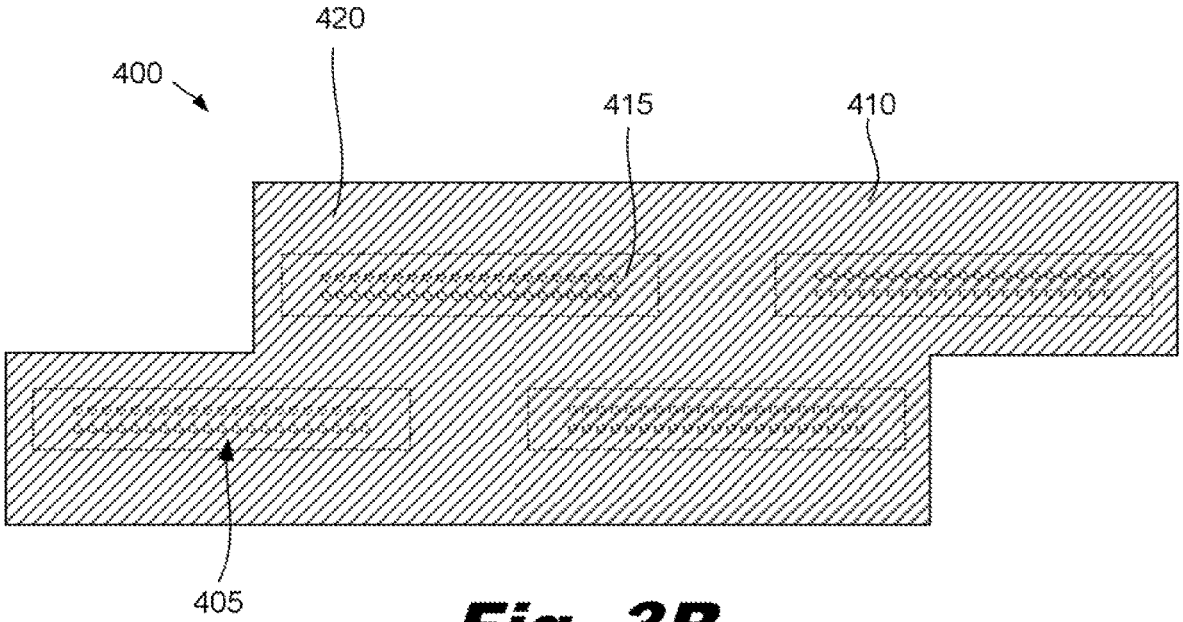
FIG. 3B is a diagram of a wide array comprising a number of nozzles according to one example of the principles described herein.

FIG. 3B is a diagram of a wide array (400) comprising a number of nozzles according to one example of the principles described herein. The wide array (400) may comprise a carrier (410) and a number of dies (415), The individual nozzles (405) and dies (415) may be communicatively coupled to a controller (FIG. 1, 120) such that each nozzle is selectively activated in order to eject an amount of fluid onto a media (FIG. 1, 115). As described above, a layer of immiscible fluid (420) may be deposited over the carrier (410), the dies (415), the nozzles (405), or combinations thereof. The application of the layer of immiscible fluid may be accomplished by the immiscible fluid applicator (FIG. 1, 180) as described above in connection with FIG. 1.

In one example, the thickness of the layer of immiscible fluid (355, 420) applied to the surface of the printhead may be 1 mm or less. In another example, the thickness of the layer of immiscible fluid is less than 100 microns.

The application of the immiscible fluid layer by the immiscible fluid applicator (FIG. 1, 180) may comprise applying a layer to the surface of the printhead (FIG. 1, 140), In one example, the immiscible fluid applicator (FIG. 1, 180) may push a volume of immiscible fluid into the nozzles and impact the nozzle bores connecting the nozzle orifice to the firing chamber in the printhead (FIG. 1, 140).

Figure 4:
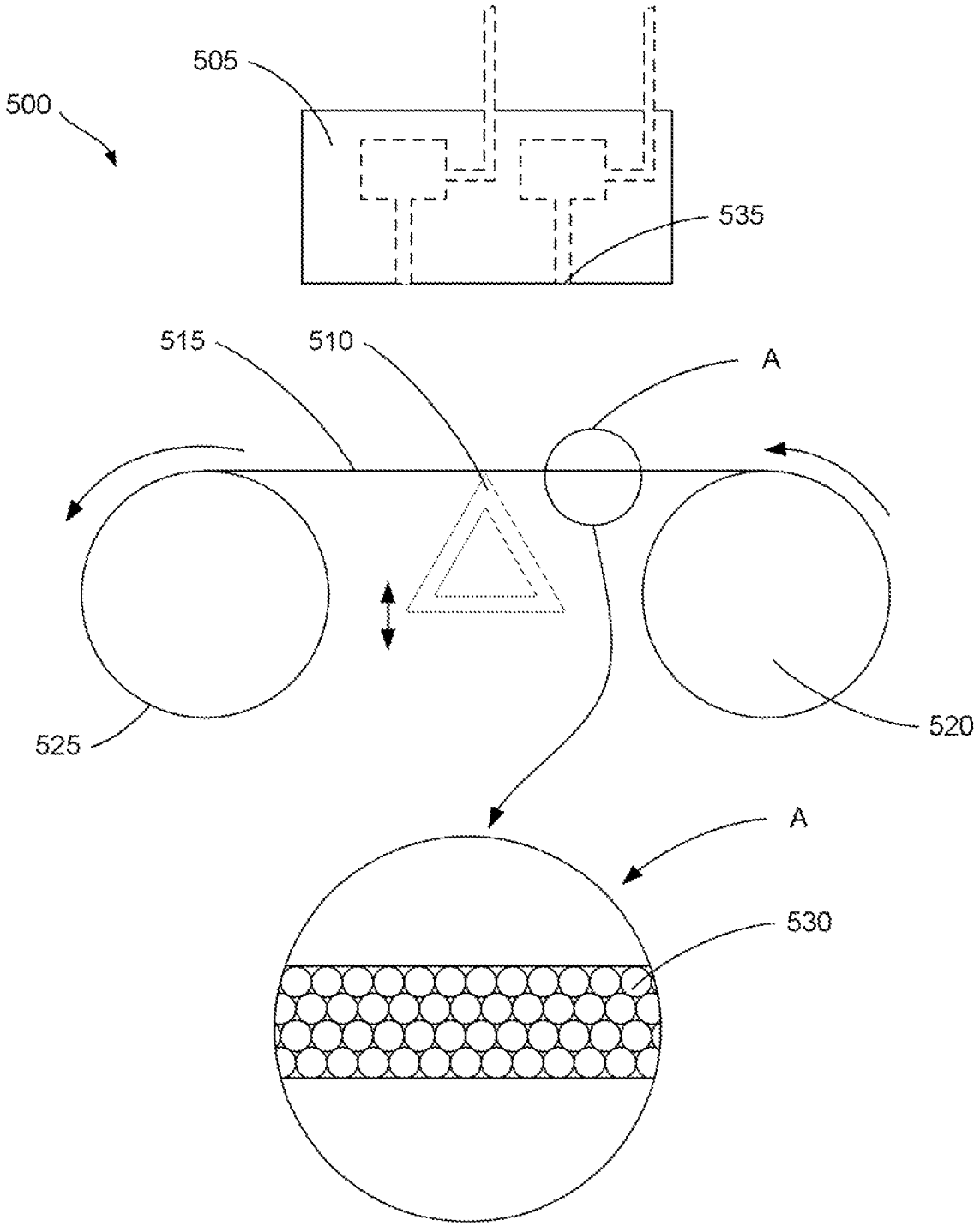
FIG. 4 is a block diagram of an immiscible fluid applicator according to one example of the principles described herein.

FIG. 4 is a block diagram of an immiscible fluid applicator (500) according to one example of the principles described herein. The immiscible fluid applicator (500) comprises a rubber blade (510) and a porous web-wipe (515). The porous web-wipe (515) is rolled across the rubber blade (510) via a supply roll (520) and a take-up roll (525). The supply roll (520) supplies the web-wipe (515) to the take-up roll (525) that winds up any used web-wipe (515). FIG. 4 comprises circle A which has been enlarged to show a side cutout view of the porous web-wipe (515). In enlarged circle A, the porous web-wipe (515) comprises a number of pours (530) into which the immiscible fluid is soaked.

In one example, instead of the porous web-wipe (515), the immiscible fluid applicator (500) may comprise a textile wipe. A textile wipe, unlike a web-wipe described above, are made out of an ordered arrangement of fibers. This ordered arrangement provides holes into which the immiscible fluid may be placed for application as described in FIG. 5.

During operation of the immiscible fluid applicator (500), the rubber blade (510) is pushed upwards toward the surface of the printhead (505). As the rubber blade (510) comes in contact with the porous web-wipe (515), the blade squeegees an amount of immiscible fluid out of the pours (530) of the porous web-wipe (515). The immiscible fluid is then wiped onto the surface of the printhead (505) covering a number of nozzles (535).

Figure 5A:
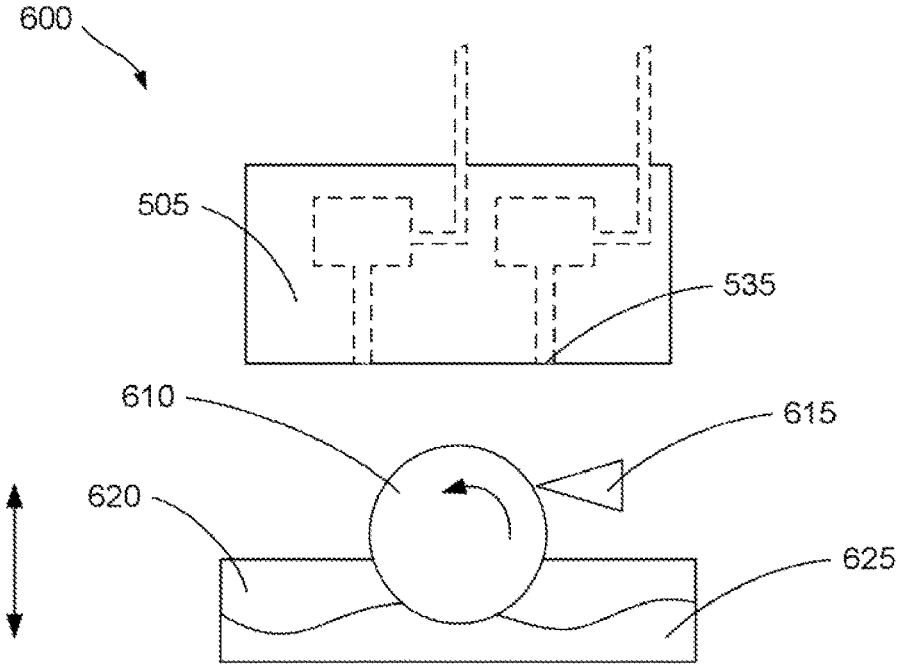
FIG. 5A is a block diagram of an immiscible fluid applicator according to another example of the principles described herein.

FIG. 5A is a block diagram of another immiscible fluid applicator (600) according to another example of the principles described herein. The immiscible fluid applicator (600) comprises a metering blade (615), a roller (610), and a container (620) holding a volume of immiscible fluid (625). The metering blade (615) meters an amount of immiscible fluid (625) onto the roller (610) as the roller (610) pulls up an amount of immiscible fluid (625) from the container (620).

During operation, the roller (610) of the immiscible fluid applicator (600) is brought into close contact with the surface of the printhead (505). As the roller (610) turns, the immiscible fluid is drawn up onto the roller (610) by surface tension. The metering blade (615) scrapes off excess immiscible fluid (625) so that a metered amount of immiscible fluid is wiped onto the surface of the printhead (505). A number of nozzles (535) are then covered by the immiscible fluid (625).

Figure 5B:
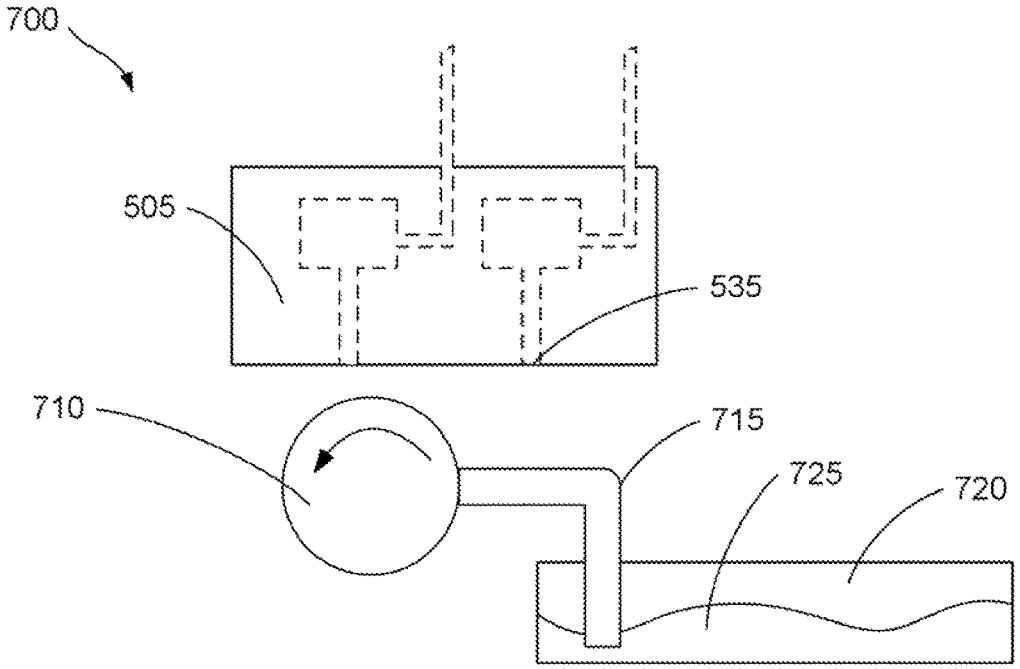
FIG. 5B is a block diagram of an immiscible fluid applicator according to another example of the principles described herein.

FIG. 5B is a block diagram of an immiscible fluid applicator (700) according to another example of the principles described herein. The immiscible fluid applicator (700) comprises a roller (710), a wick (715), and a container (720) comprising a volume of immiscible fluid (725).

During operation, the roller (710) of the immiscible fluid applicator (700) is brought into close proximity to the surface of the printhead (505). The wick (715) provides to the surface of the roller (710) an amount of immiscible fluid (725) due to the capillary forces of the wick (715). The characteristics of the capillary forces of the wick (715) may be such that a metered amount of immiscible fluid (725) is wicked onto the surface of the roller (710). The roller (710), being in close proximity to the surface of the printhead (505), wipes an amount of immiscible fluid (725) onto the surface of the printhead (505) covering a number of nozzles (535).

Figure 6A:
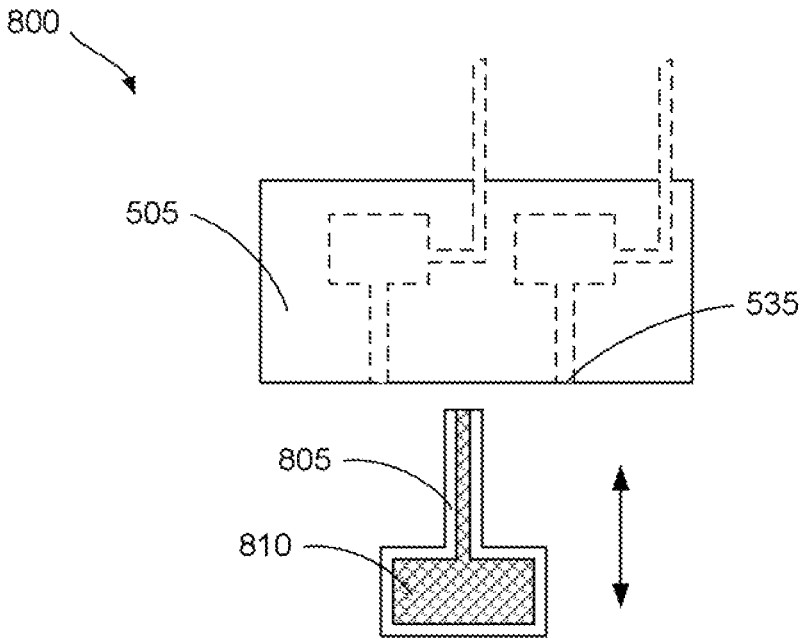
FIG. 6A is a block diagram of an immiscible fluid applicator according to another example of the principles described herein.

FIG. 6A is a block diagram of an immiscible fluid applicator (800) according to another example of the principles described herein. The immiscible fluid applicator (800) comprises a rubber wiper (805), the rubber wiper (805) comprising an immiscible fluid chamber (810) into which a volume of immiscible fluid is provided. In one example, the immiscible fluid is provided to the immiscible fluid chamber (810) by an immiscible fluid line.

Figure 6B:
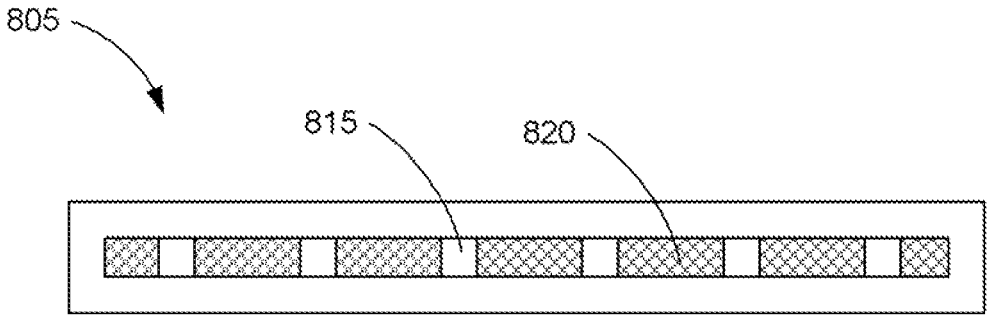
FIG. 6B is a block diagram of a top view of the rubber wiper according to one example of the principles described herein.

During operation, the rubber wiper (805) is brought up to the surface of the printhead (505). As the rubber wiper (805) is bent against the surface of the printhead (505) an amount of immiscible fluid from the immiscible fluid chamber (810) is wiped onto the surface of the printhead (505). FIG. 6B is a block diagram of a top view of the rubber wiper (805) according to one example of the principles described herein. The rubber wiper (805) may comprise a number of ribs (815) that run the length of the rubber wiper (805). The ribs (815) may provide support within the cavity of the rubber wiper (805) as well as form a number of channels (820) through which an amount of immiscible fluid may flow from the immiscible fluid chamber (810) to the surface of the printhead (FIG. 6A, 505) covering a number of nozzles (FIG. 6A, 535).

Figure 7A:
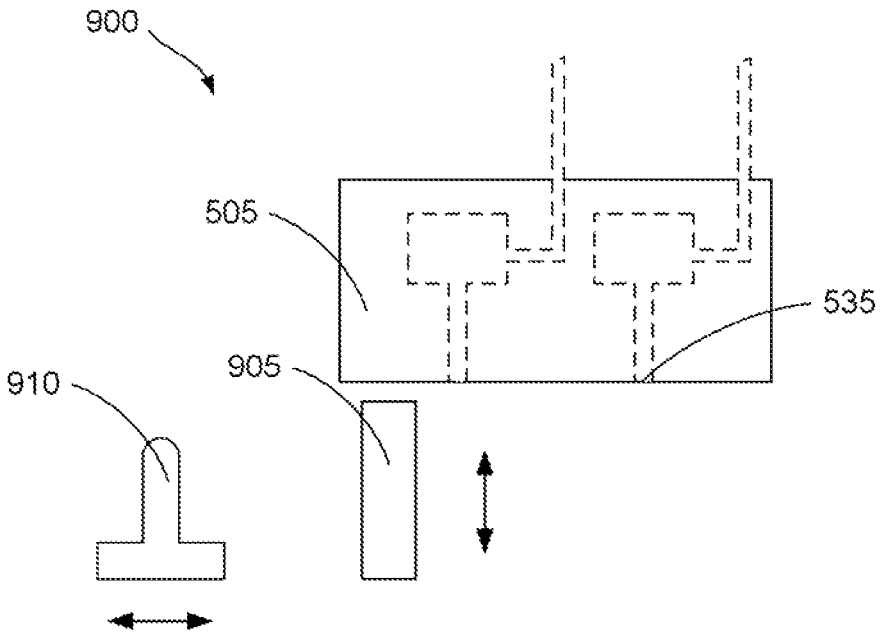
FIG. 7A is a block diagram of an immiscible fluid applicator according to another example of the principles described herein.

FIG. 7A is a block diagram of an immiscible fluid applicator (900) according to another example of the principles described herein. The immiscible fluid applicator (900) may comprise a wick (905) and a rubber wiper (910). The wick (905) comprises an amount of immiscible fluid that is retained in the wick (905) by capillary forces. In one example, the wick (905) is brought across the surface of the printhead (505) depositing an amount of immiscible fluid. The amount of immiscible fluid may vary due to the properties of the wick (905). Once the immiscible fluid is deposited onto the surface of the printhead (505) the rubber wiper (910) wipes across the surface of the printhead (505) covering a number of nozzles (535).

Figure 7B:
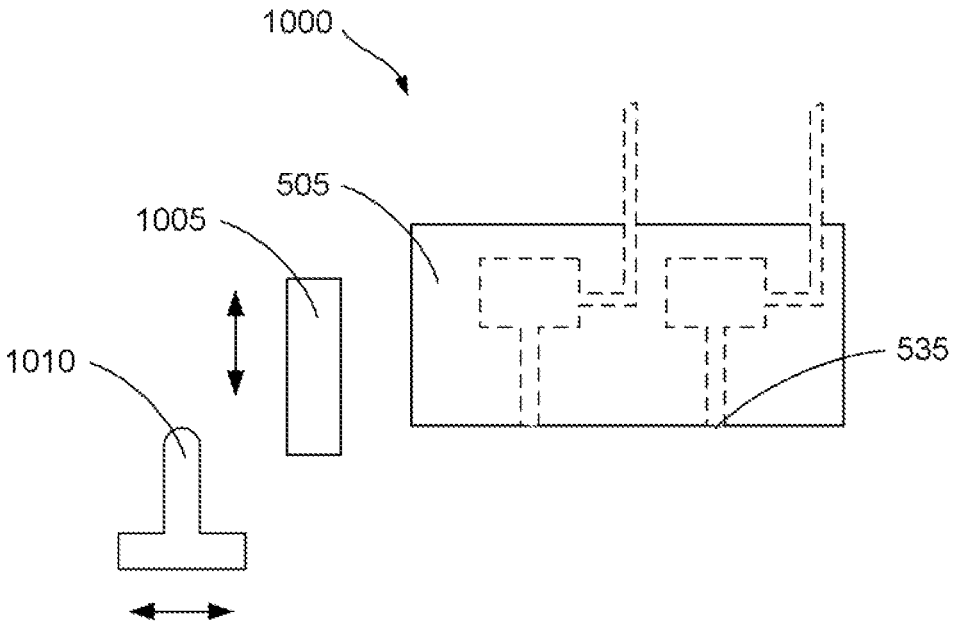
FIG. 7B is a block diagram of an immiscible fluid applicator according to another example of the principles described herein.

FIG. 7B is a block diagram of another immiscible fluid applicator (1000) according to another example of the principles described herein. The immiscible fluid applicator (1000) in this example also comprises a wick (1005) and a rubber wiper (1010). The wick (1005) comprises an amount of immiscible fluid that is retained in the wick (1005) by capillary forces. During operation, the rubber wiper (1005) wipes across the wick (1005) receiving an amount of immiscible fluid. The rubber wiper (1005) moves across the surface of the printhead (505) covering a number of nozzles (535).

Figure 8:
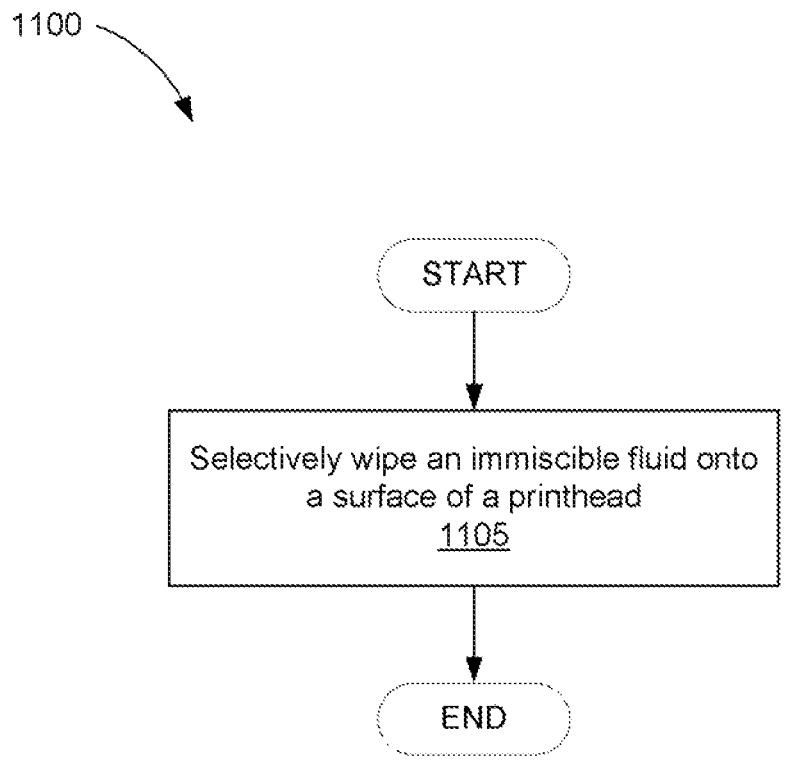
FIG. 8 is a flowchart showing a method of applying a cap to a printhead according to one example of the principles described herein.

FIG. 8 is a flowchart showing a method (110) of applying a cap to a printhead according to one example of the principles described herein. The method (1100) may begin with selectively wiping (1105) an immiscible fluid onto a surface of a printhead (FIG. 1, 140). The immiscible fluid caps a number of nozzles on a number of dies incorporated into the printhead (FIG. 1, 140), The application of the immiscible fluid may be accomplish by the immiscible fluid applicators described in connection with FIGS. 1-7B.

The present method (1100) may be accomplished through the use of a computer program product with the computer program product comprising a computer readable storage medium comprising computer usable program code embodied therewith. In this example, the computer usable program code may comprise computer usable program code to, when executed by a processor (FIG. 1, 145), selectively wipe an immiscible fluid onto a surface of a printhead (FIG. 1, 140).

Aspects of the present system and method are described herein with reference to flowchart illustrations and/or block diagrams of methods, apparatus (systems) and computer program products according to examples of the principles described herein. Each block of the flowchart illustrations and block diagrams, and combinations of blocks in the flowchart illustrations and block diagrams, may be implemented by computer usable program code. The computer usable program code may be provided to a processor of a general purpose computer, special purpose computer, or other programmable data processing apparatus to produce a machine, such that the computer usable program code, when executed via, for example, the processor (FIG. 1, 145) of the printer (FIG. 1, 105) or other programmable data processing apparatus, implement the functions or acts specified in the flowchart and/or block diagram block or blocks. In one example, the computer usable program code may be embodied within a computer readable storage medium; the computer readable storage medium being part of the computer program product. In one example, the computer readable storage medium is a non-transitory computer readable medium.

The specification and figures describe a method and system for applying a cap to a number of nozzles on a printhead. The application of an immiscible fluid to the surface of the printhead prevents the nozzles of the printhead from drying up and being damaged as described above.

The preceding description has been presented to illustrate and describe examples of the principles described. This description is not intended to be exhaustive or to limit these principles to any precise form disclosed. Many modifications and variations are possible in light of the above teaching.

What is claimed is:

1. A printer comprising:

a printhead comprising a number of nozzles;

an immiscible fluid applicator; and a processor to instruct the immiscible fluid applicator to apply immiscible fluid to the surface of the printhead to cap the number of nozzles.

2. The printer of claim 1, in which the immiscible fluid applicator comprises a wick.

3. The printer of claim 2, in which the wick is to supply an amount of immiscible fluid to a wiper and in which the wiper is to wipe the amount of immiscible fluid onto the surface of the printhead.

4. The printer of claim 2, in which the immiscible fluid applicator further comprises a wiper to wipe the printhead after immiscible fluid has been applied to the printhead by the wick to leave an amount of immiscible fluid on the printhead.

5. The printer of claim 1, in which the immiscible fluid applicator comprises a roller to supply an amount of immiscible fluid to the surface of the printhead.

6. The printer of claim 5, in which the immiscible fluid applicator further comprises an immiscible fluid supply to supply an amount of immiscible fluid to the roller.

7. The printer of claim 5, in which the immiscible fluid applicator further comprises a wick to supply an amount of immiscible fluid to the roller.

8. The printer of claim 1, in which the immiscible fluid applicator comprises a wiper comprising an immiscible fluid channel in which the wiper wipes across the surface of the printhead while the immiscible fluid channel in the wiper ejects an amount of immiscible fluid.

9. The printer of claim 1, in which the immiscible fluid applicator comprises a porous web-wipe to apply an amount of immiscible fluid onto the surface of the printhead.

10. The printer of claim 9, in which the immiscible fluid applicator further comprises a blade to squeegee an amount of immiscible fluid from the web-wipe and onto the surface of the printhead.

11. A printer comprising:

a printhead;

an immiscible fluid applicator to wipe a layer of immiscible fluid over a printhead to cap nozzles over the width of the printhead; and a controller to instruct the printhead to print after the layer of immiscible fluid has been applied over the printhead so that ink ejects through the immiscible fluid while non-used nozzles remain capped by the immiscible fluid layer.

12. The printer of claim 11, wherein the immiscible fluid comprises isoparaffin.

13. The printer of claim 11, wherein the printhead comprises a cartridge with a memory chip providing data when the immiscible fluid layer will be applied.

14. The printer of claim 11, wherein a surface tension of the immiscible fluid is sufficient high that, after ink has been ejected through the immiscible fluid, the immiscible fluid reseals and covers a nozzle from which ink was ejected.

15. The printer of claim 11, wherein a thickness of the layer of immiscible fluid is 1 mm or less.

16. The printer of claim 11, wherein the applicator comprises a textile wipe.

* * * * *